US007289923B2

(12) United States Patent
Marovitz

(10) Patent No.: US 7,289,923 B2
(45) Date of Patent: Oct. 30, 2007

(54) SYSTEM AND METHOD FOR FLUID DISTRIBUTION

(75) Inventor: Daniel Jordan Marovitz, New York, NY (US)

(73) Assignee: Nagare, New York, NY (US)

( * ) Notice: Subject to any disclaimer, the term of this patent is extended or adjusted under 35 U.S.C. 154(b) by 0 days.

(21) Appl. No.: 11/284,737

(22) Filed: Nov. 22, 2005

(65) Prior Publication Data

US 2007/0021936 A1 Jan. 25, 2007

Related U.S. Application Data

(60) Provisional application No. 60/701,437, filed on Jul. 21, 2005.

(51) Int. Cl.
*G06F 19/00* (2006.01)

(52) U.S. Cl. ..... 702/100; 714/25

(58) Field of Classification Search ..... 702/100, 702/182–185, 188, 189; 324/76.11; 714/25, 714/30, 47, 39, 42; 340/592
See application file for complete search history.

(56) References Cited

U.S. PATENT DOCUMENTS 4,584,654 A * 4/1986 Crane ..... 702/44
2005/0226153 A1* 10/2005 Scifres et al. ..... 370/232
2005/0251339 A1* 11/2005 Araki et al. ..... 702/2
2006/0265194 A1* 11/2006 Araki et al. ..... 702/188

* cited by examiner

*Primary Examiner*—Edward Raymond
(74) *Attorney, Agent, or Firm*—Fay Kaplun & Marcin, LLP

(57) ABSTRACT

A system comprises a plurality of sensors disposed at predetermined locations in a fluid distribution network and a server receiving sensor data from the sensors indicative of at least one predetermined characteristic of flow through the network, the server comparing the sensor data to stored data to determine an existence of a problem condition in the network and, when a problem condition is determined to exist, executing a predetermined response procedure.

18 Claims, 4 Drawing Sheets

SYSTEM AND METHOD FOR FLUID DISTRIBUTION

PRIORITY CLAIM

The present invention relates to U.S. Provisional Patent Application No. 60/701,437 entitled "Water Distribution" filed Jul. 21, 2005, the entire disclosure of which is incorporated herein by reference.

BACKGROUND

Contamination and shortages in water distribution systems contribute to some of the most significant problems in developing and developed countries. In developing countries, it has been estimated that up to 80% of diseases are caused by water contamination, and that, presently, about 400 million people face water shortages. In developed countries, reliance on decades- or centuries-old infrastructures for water management and distribution gives way to inefficiencies such as "unaccounted for water"—water lost through leakage or theft—which routinely exceeds 15% of the total water supplied.

SUMMARY OF THE INVENTION

In one aspect, the present invention is directed to a system comprising a plurality of sensors disposed at predetermined locations in a fluid distribution network and a server receiving sensor data from the sensors indicative of at least one predetermined characteristic of flow through the network, the server comparing the sensor data to stored data to determine an existence of a problem condition in the network and, when a problem condition is determined to exist, executing a predetermined response procedure.

In another aspect, the present invention relates to a method comprising receiving sensor data from a plurality of sensors disposed at predetermined locations in a fluid distribution network, the sensor data indicative of at least one predetermined characteristic of flow through the network, comparing the sensor data to stored data to determine an existence of a problem condition in the network, executing a predetermined response procedure when the problem condition is determined to exist.

DETAILED DESCRIPTION

Figure 1:
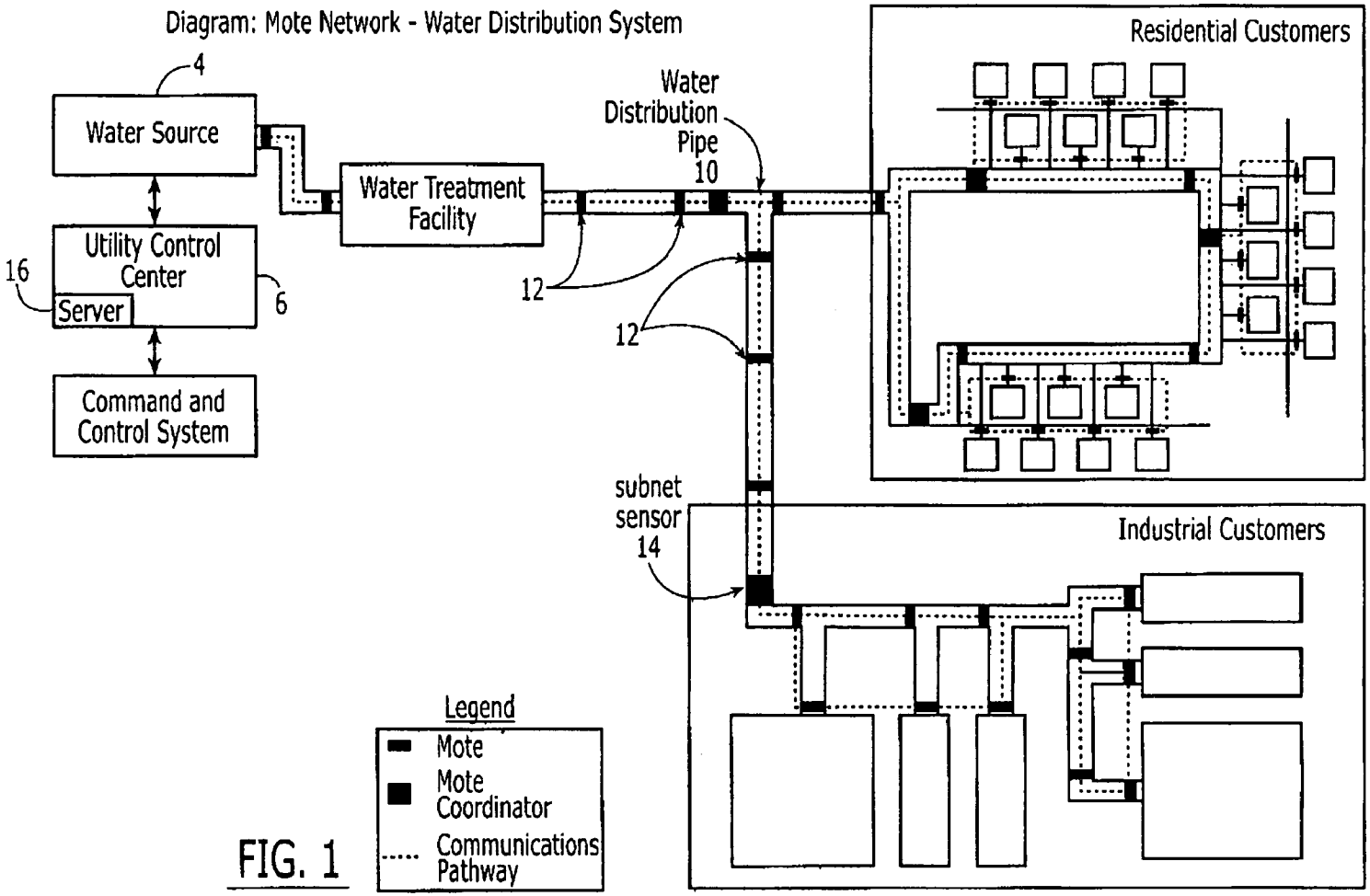
FIG. 1 shows an exemplary embodiment of a system for water distribution according to the present invention.

The present invention may be further understood with reference to the following description and the appended drawings, wherein like elements are provided with the same reference numerals. The present invention discloses a system and method for water distribution. While an exemplary embodiment of the present invention will be described with respect to a system for monitoring and managing water distribution, those of skill in the art will understand that the present invention may provide feedback for other systems including, but not limited to, drinking water systems, sewage systems, irrigation systems, oil pipelines, gas lines and/or energy-delivery systems (e.g., utilities).

Difficulties in monitoring the millions of miles of water pipes throughout the world are a significant factor in the water contamination, shortage, loss and theft described above, preventing water operators from being proactive in addressing these problems. For example, a leak in an underground water supply line may not be evident until there is surface pooling. At this point, customers may have already experienced service deficiencies and/or shortages, and the leak may have caused damage to components of the water distribution system. Furthermore, locating the leak may be difficult as the surface pooling may occur at a site remote from the leak. After a field specialist has arrived at the site, located and diagnosed the leak, time will be needed to cure the shortage and repair the leak and any damage caused thereby.

The water operator and its customers may also experience billing problems along with service interruptions and shortages. For example, a water meter at the consumer's building is rarely read by the water operator to determine an actual amount of water used for a particular period. The water operator typically estimates the amount and charges the customer based on the estimate. Thus, the customer may pay more than the amount actually used (i.e., overestimation), or less than the amount actually used (i.e., underestimation).

FIG. 1 shows an exemplary embodiment of a system 2 for water distribution according to the present invention. The system 2 which may be deployed, for example, to supply water to residential and/or industrial customers, includes a water source 4 (e.g., a reservoir) monitored by a utility control center 6 with flow from the water source 4 passing through a water treatment facility 8 to the customers. The water source 4, the treatment facility 8 and the customers are interconnected by a series of water distribution conduits (e.g., pipes 10) which are part of the infrastructure of the system 2. The infrastructure of the exemplary system 2 further includes devices which are part of conventional water systems, e.g., pumps, valves, tanks, etc. The control center 6 also regulates the treatment facility 8 to test a quality of the water, control purification and regulate the flow discharged to the pipes 10. Those of skill in the art will understand that the present invention may be implemented in an existing water distribution system and/or a newly deployed system.

Sensors 12 are coupled to the pipes 10 at various locations. An exemplary sensor 12 includes a sensing arrangement for collecting/measuring data indicative of one or more characteristics of the flow and a communication arrangement for communicating the data over a communication network. For example, the sensors 12 may be what are conventionally referred to as 'Motes' or 'Smartdust.' Each sensing arrangement may measure, for example, one or more of temperature, humidity, barometric pressure, ambient light, pressure, flow rate, conductivity and/or dissolved oxygen, hydrogen sulfide gas and/or a contaminant level of the water flow. The measurements obtained by the sensors 12 are transmitted via the communication arrangements over a wired and/or wireless communication network to the control center 6, to other sensors and/or to remote computing devices used by field personnel, etc. The communication network may constitute wired and/or wireless components (e.g., hubs, switches, bridges, etc.) which interconnect the sensors 12 and the control center 6. As would be understood by those skilled in the art, the sensors 12 may be deployed when the system 2 is installed or, alternatively, a system 2 may be incorporated into existing infrastructure with sensors 12 being coupled to the pipes 10 during, for example, regular maintenance/servicing activities, repairs, deployment of additional pipes, etc.

In one embodiment, the sensors 12 utilize a mesh communication network, in which all of the sensors 12 are communicatively linked to each other. The mesh utilizes a root node sensor connected to the control center 6 so that all transmissions coming into the control center 6 are funneled through the root node. An end node sensor on a pipe near a customer's residence may utilize a particular transmission path, including one or more intermediate node sensors and the root node, when sending signals to the control center 6. However, when one of the intermediate sensors malfunctions or is taken offline, the end node preferably determines an alternative transmission path utilizing a further intermediate sensor to maintain communications.

In another embodiment, the sensors 12 are arranged in subnets each of which services a particular area. For example, a municipality may be divided into grids each of which is serviced by a corresponding pipeline with the sensors 12 on each pipeline communicatively linked to the other sensors on the pipeline to form a subnet. The subnet is preferably managed by a subnet sensor 14 which is linked to further subnet sensors and the control center 6. The subnet sensors 14 obtain data from the sensors 12 and provide the data to the further subnet sensors and the control center 6 to monitor and manage the system 2.

Each sensor 12 includes a communication arrangement which is, for example, a transceiver, an Ethernet port and/or an infrared/UV port. When the sensor 12 is deployed, it is configured for the type of communication it will conduct. For example, when a sensor 12 is placed on a pipe 10 which is underground, the transceiver is activated to allow the sensor 12 to communicate with other sensors using a wireless communication protocol (e.g., 802.1x, Bluetooth®, GPRS, ZigBee, etc.). When the Ethernet port is utilized, a wired communication protocol (e.g., TCP/IP) may be used for communication. Also, when the sensor 12 is deployed it may be set to measure one or more of the characteristics of the water flow. For example, the sensor 12 may be fitted to an external surface of the pipe 10 and cabled to a water pressure sensor inside the pipe 10 for measuring water pressure of the water flow therein. However, as would be understood by those skilled in the art, one or more of these characteristics may be remotely changed via instructions from the control center 6 or manually changed by field personnel.

Figure 2:
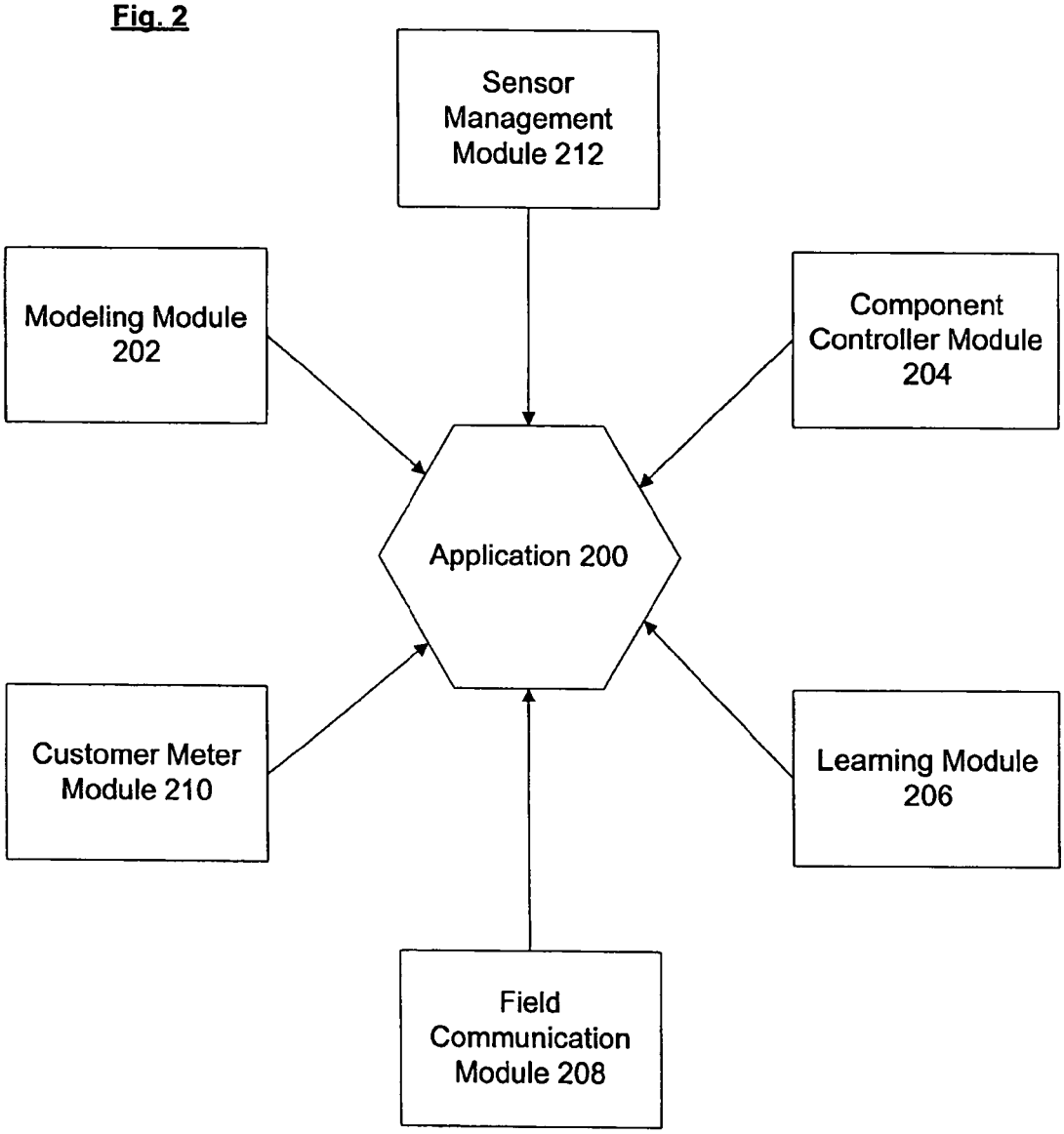
FIG. 2 shows an exemplary embodiment of a software application for monitoring and managing the system according to the present invention.

At the control center 6, a server 16 hosts a distribution system management application 200, shown schematically in FIG. 2, which utilizes one or more software modules and/or databases to monitor and manage the system 2. The application 200 utilizes, for example, a modeling module 202 simulating operation of the system 2 and generating data based on the simulation. As input, the modeling module 202 uses information such as, but not limited to, topography of the region, configuration/type of pipes, number/type of customers supplied, the water source 4, locations of valves and pumps, etc. The data yielded by the simulation may include pressures and/or water quality at various locations corresponding to current and/or desired future locations of sensors 12. Thus, the data from the simulation may be used for comparison during actual operation of the system 2, as will be described below.

The modeling module 202 may also be used to generate data reflecting an impact on the system 2 of one or more of a plurality of events. For example, the modeling module 202 may simulate the addition, removal or disabling of a component (e.g., pump, valve, tank, etc.), breaks and/or leaks in the pipes 10, the removal of regions of pipes, interruptions in service, etc. The effect of upgrades on the components and/or pipes may also be simulated. For example, a change in material and/or diameter of preselected pipes may be simulated as well as the effects of time or "aging" on the system 2.

The application 200 also includes a component controller module 204 monitoring and controlling the operation of components of the system 2. The module 204 according to this embodiment utilizes a telemetry system to remotely control pumps, valves, storage tanks, etc. during operation of the system 2. These components may also provide operating data to the control center 6 via the communication network. For example, operating data from a valve may indicate whether the valve is completely/partially open or closed and/or a current rate of flow therethrough.

A learning module 206 may be utilized by the application 200 to predict future behaviors and anticipated needs of the system 2. As would be understood by those skilled in the art, the learning module 206 may operate in a manner similar to a neural network learning about the system 2 based on known data (e.g., topography, pipe materials, water pressures, etc.) and collected data from the sensors 12, and making inferences and suggestions based thereon.

The application 200 according to this embodiment further includes an optional field communication module 208 for communicating with field personnel and/or remote stations. The module 208 is preferably equipped for bidirectional wired and/or wireless communication. For example, the control center 6 may be connected to a wired communications network (e.g., LAN, WAN, Internet, Intranet) which is accessible by the field personnel. The control center 6 may also include a transceiver for conducting wireless communications in, for example, a WLAN or a WWAN. When there is a problem in the system 2 (e.g., a leak), the control center 6 may contact field personnel to request their assistance in assessing and fixing the problem. Alternatively, the field personnel may access the application 200 to determine the status of the system 2. For example, a field operative may carry a mobile computing device 209 (e.g., a PDA, tablet, laptop, handheld computer, etc.) which communicates with the control center 6 to access the data contained therein (e.g., the data from the sensors 12). However, in other embodiments, the computing devices 209 used by field personnel may communicate directly with the sensors 12 and other components of the system 2. For example, the computing device 209 may host the application 20 and collect data directly from one or more of the sensors 12.

The application 200 may also receive data from a customer meter module 210 which obtains readings from meters at customer locations. For example, a customer meter may be coupled to a phone line connected to and/or accessible by the control center 6 or equipped for wireless communications with the control center 6. The module 210 harvests and stores readings from customer meters which are then used for billing operations and/or service monitoring by the control center 6.

A sensor management module 212 stores and/or analyzes data received from the sensors 12. During operation of the system 2, the data from the sensors 12 may be harvested at a predetermined interval (e.g., approximately 10 minutes) and compared to the simulation data and/or predetermined threshold levels to determine whether a problem exists in the system 2. The module 212 may also respond to data requests from users at the control center 6 and/or in the field. For example, a report about a predetermined region of the system 2 may be generated which includes data from a plurality of sensors 12. The readings currently stored by the module 212 may be utilized and/or the module 212 may provide real-time updates of the readings.

Figure 3:
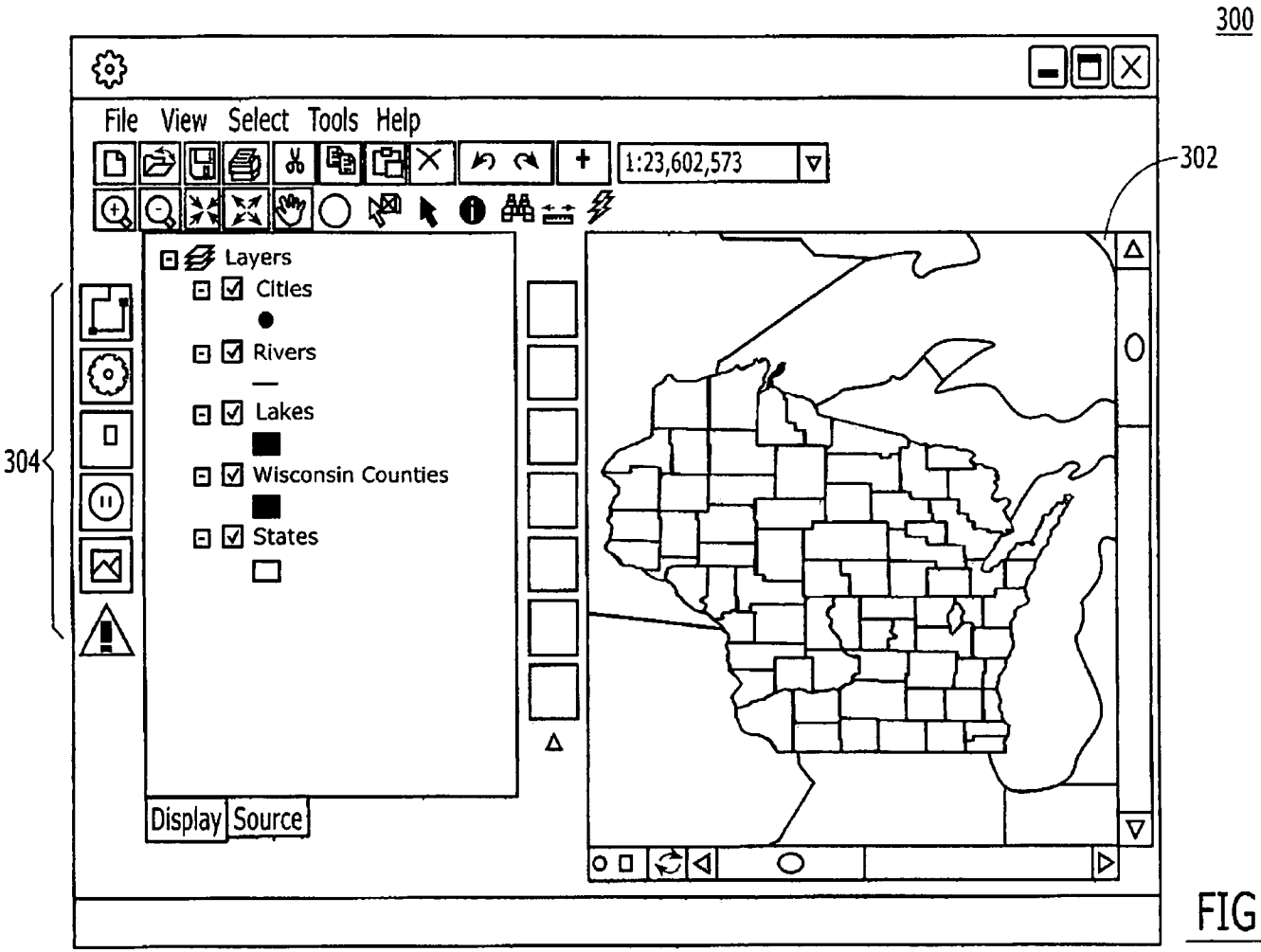
FIG. 3 shows an exemplary embodiment of an interface of the software application according to the present invention.

FIG. 3 shows an exemplary interface 300 (e.g., a GUI) for the application 200 which may be presented on the server 16 and/or the computing device 209. The interface 300 according to this embodiment includes a map image 302 of a preselected geographic region and a module toolbar 304 for accessing the modules of the application 200 allowing a user to monitor and manage the system 2 as would be understood by those skilled in the art. For example, when a problem occurs, an alert may be provided on the interface 300 so that the location of the problem may be determined and a response provided, as will be described below. The map image 302 may be magnified to provide an image of the location of the problem, which may resemble an image similar to the system diagram in FIG. 1. That is, resolution of the map image 302 may be adjusted to provide selectively more or less detailed views of a particular area as desired.

The interface 300, allows the system 2 to be remotely monitored in real-time. For example, the application 200 may utilize mouse-hover technology so that, when a cursor is placed over a portion of the map image 302, data regarding that portion is displayed. This may be done at any level of resolution on the map image 302 as would be understood by those skilled in the art. For example, when the cursor is positioned over an individual sensor 12, the data obtained by the sensor 12 is displayed. Data from the sensors 12 may be collected continuously, at predetermined intervals and/or at user-selected times. However, it is preferable that, when a problem is detected, the data for at least a portion of the system 2 relevant to the problem is updated in real-time.

In one embodiment, the interface 300 further includes a layering function for use with the map image 302. A first layer may display, for example, the topography of a preselected geographic region and/or customer locations while a second layer, superimposed on the first layer, shows the infrastructure of the portion of the system 2 corresponding to the image of the first layer. Thus, at the second layer, a user may view the locations of pipes 10, valves, tanks, pumps, etc. overlaid on the geographic region of the first layer. A third layer may display the locations of sensors 12 and/or the communication network utilized by the system 2 superimposed on the second layer. The third layer may be most useful when a problem in the system 2 is identified. For example, if a particular sensor reports an unexpected drop in flow pressure, that sensor may be highlighted on the map image 302. Thus, the control center 6 may be made aware of the problem. Additionally, field personnel may be alerted to the problem through the control center 6 or the sensor itself via, for example, broadcast of an alert signal. A fourth layer may display the data collected by the sensors, status of the pumps, valves, tanks, direction of the flows, etc.

Figure 4:
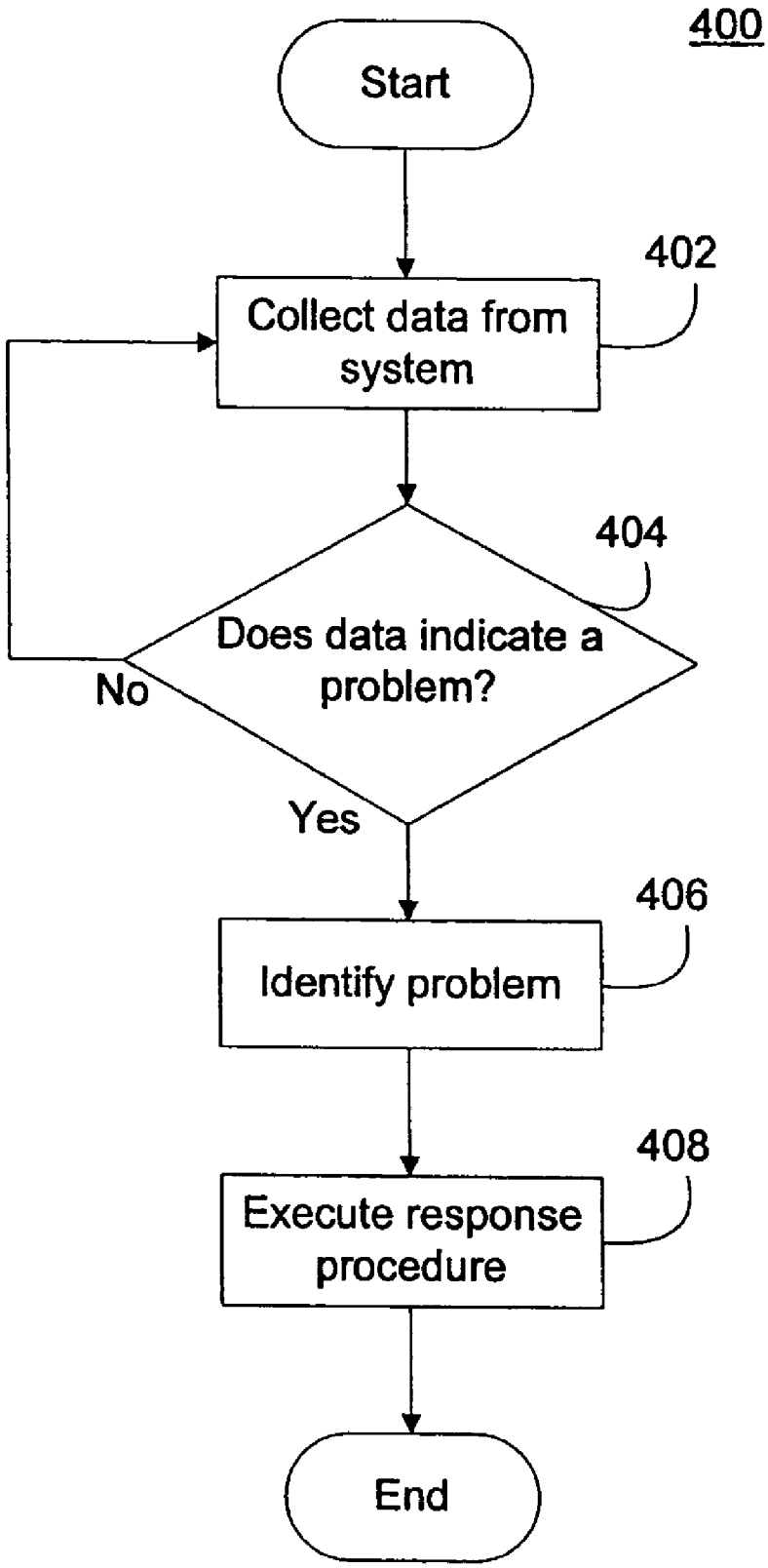
FIG. 4 shows an exemplary embodiment of a method for monitoring the system according to the present invention.

FIG. 4 shows an exemplary embodiment of a method 400 for monitoring a water distribution system according to the present invention. In particular, the method 400 describes a response to a problem detected in the system 2. While the method 400 will be described with respect to the system 2 shown in FIG. 1 and the interface 300 shown in FIG. 3, those of skill in the art will understand that other systems may implement the present invention and utilize various embodiments of the interface. For example, the interface is preferably tailored to a type of the system (e.g., water, sewage, oil, etc.). Further, the method 400 may be implemented on any device (e.g., the server 14, the computing device 205, etc.) with access to the data generated by the system 2.

In step 402, data including, but not limited to, readings from the sensors 12, status of the pumps, tanks, valves, etc. is collected from the system 2 and in step 404, it is determined whether the data indicates a problem (e.g., leak, blockage, mechanical failure of a component, etc.) in the system 2. To determine the existence of a problem, the collected data is compared to the simulated data described above and/or operational data collected during operation of the system 2 when the problem did not exist. The operational data is collected after deployment of the system 2, and may include threshold values (e.g., minimum pressures, flow rates, purity, etc.) included by the water operator and reflecting, for example, predetermined levels of service to the various customers. When any of the collected data is not within a predetermined acceptable range of the simulated or operational data, a problem indicated. If the problem is detected at the sensor 12, the server 14 may poll adjacent sensors to determine an extent of the problem. Those of skill in the art will understand that the simulated and/or operational data may include preset levels which are minimums at which the system 2 is determined to be operating without a problem. If the collected data does not indicate the existence of a problem, data collected from the system 2 is continued and the analysis is ongoing.

In step 406, a problem has been detected and is identified and/or classified as a function of the collected data. For example, a plurality of sensors located along a stretch of pipe may provide information indicating that pressure and/or flow rate in a corresponding portion of the pipe has moved outside the acceptable range. Alternatively, a difference in any of these values from sensors 12 along a pipe (e.g., indicating a significant drop in pressure relative to preceding sensors) may be determined to be indicative of a problem. The learning module 206 may, for example, also take into account the operational status and locations of the valves, pumps and tanks adjacent to and effecting the particular stretch of pipe. For example, the drop in pressure may indicate that a leak has occurred, that water is being illegally siphoned or that a particular valve which should be closed is open. The learning module 206 may analyze the collected data to identify one or more possible causes of the problem (e.g., leak, malfunctioned valve, etc.) and to determine a location thereof.

The map image 302 preferably highlights a region corresponding to the location(s) of a problem. In the above example, the map image 302 may change to a resolution showing a detailed view of the region with the sensor(s) whose data indicate a problem highlighted and displaying a current pressure (or other parameter) measured thereby. Also, the potential cause(s) of the problem may be displayed, along with one or more proposed response procedures for rectifying the problem. The proposed response procedures may be generated by the learning module 206 as a function of the identity and/or location of the problem. In a simulation response mode, the user may select one or more proposed response procedures and simulate the response of the system 2 based on the execution thereof. This may be advantageous when the response procedures would limit or shut-off service to one or more customers. Thus, flow may be rerouted and/or additional flow provided to compensate for the limited or temporarily discontinued service.

In step 408, a response procedure is executed. The response procedure may be selected from the one or more proposed response procedures generated by the learning module 206. Selection of the proposed response procedure(s) may automatically execute a series of actions and update the data from the system 2 as a result of the actions. For example, valves, pumps and tanks may be automatically adjusted to compensate for the problem. As described above, using the system 2, these actions may be executed by instructions included in wireless signals transmitted from the control center 6 to the system 2. The instructions may also be transmitted to the field personnel to perform some action on the system 2. Alternatively, the system 2 may generate a report indicating the problem or problems detected and a list of recommended actions to be taken in response.

The response procedure may alternatively include one or more actions which are entered at the interface 300 and/or performed by field personnel. That is, the water operator may determine that the proposed response procedure(s) would not rectify the problem in a manner desired and enter instructions for the response procedure manually at the interface 300. As described above, the instructions may include signals to the valves, pumps and/or tanks and/or field personnel. The signals may further include messages (e.g., emails, voice messages) to customers reporting any service issue that may arise as a result of the response procedure.

In another exemplary embodiment, when one problem is detected, the system 2 analyzes adjacent parts of the system 2 for further problems. If the further problems are detected, the learning module 206 may indicate that the problems are not coincidental, but are likely the result of intentional activity (e.g., sabotage of or theft from the system 2).

In a further exemplary embodiment, the system 2 may be implemented on a storm water drainage system. The system 2 identifies a problem when a chemical amount (e.g., Chlorine/Chloramines) exceeds a predetermined threshold (e.g., 0.2 mg/L). Typically, the storm water drainage system may experience intermittent spikes in Chlorine upon receipt of influx from a potable water system (e.g., washing a car, watering a lawn). The system 2 may be trained to overlook the intermittent spikes. However, when the chemical amount does not subside or the spikes are closer temporally, the system 2 may identify a persistent influx of potable water into the storm water drainage system. The learning module 206 may indicate that this is due to a water main leak in the potable water system.

Although the method 400 has been described with reference to an actual problem in the system 2, anticipated problems may be determined, as well. For example, the map image 302 may display "hotspots" which are areas in the system 2 that have the potential to become actual problems. The hotspots may include areas of flow loss, high pitting in the pipes 10, galvanic activity, etc. which may be identified using the data collected from the sensors 12. The interface 302 and/or the field personnel may receive updates on status of the hotspots and preemptive action may be taken.

The present invention provides real-time monitoring for a water distribution system which the water operator may utilize to more efficiently manage the system. The system allows the operator to identify and responded to problems quickly and to anticipate and prepared for problems as well. The present invention also provides connectivity between the field personnel and a control center 6, and further allows the field personnel to harvest data while in the field.

The present invention has been described with reference to specific exemplary embodiments. Those skilled in the art will understand that changes may be made in details, particularly in matters of shape, material and arrangement of parts without departing from the teaching of the invention. Accordingly, various modifications and changes may be made to the embodiments without departing from the broadest scope of the invention as set forth in the claims that follow. The specifications and drawings are, therefore, to be regarded in an illustrative rather than a restrictive sense.

What is claimed is:

1. A system, comprising:

a plurality of sensors disposed at predetermined locations in a fluid distribution network, wherein the sensors include at least one of Motes and Smartdust; and a server receiving sensor data from the sensors indicative of at least one predetermined characteristic of flow through the network, the server comparing the sensor data to stored data to determine an existence of a problem condition in the network and, when the problem condition is determined to exist, executing a predetermined response procedure, the server including a display showing a map image of the fluid distribution network, wherein the server utilizes a layering function to project on the map image at least one of (i) a topography of land underlying the fluid distribution network, (ii) an infrastructure of the fluid distribution network, (iii) locations of the plurality of sensors and (iv) the sensor data generated by each of the plurality of sensors.

2. The system according to claim 1, wherein the network is one of a drinking water network, a sewage network, an oil network, a gas network and an irrigation network.

3. The system according to claim 1, wherein each sensor includes a sensing arrangement generating the sensor data and a communication arrangement communicating the sensor data over a communications network to one of at least one further sensor and the server.

4. The system according to claim 3, wherein the communications network is one of a wireless mesh network, a WLAN and a WWAN.

5. The system according to claim 1, wherein sensor data includes at least one of temperature, humidity, barometric pressure, ambient light, pressure, flow rate, conductivity, dissolved oxygen, hydrogen sulfide gas and contaminant level.

6. The system according to claim 1, wherein the sensors are grouped into subnets managed by a subnet head arrangement which communicates the sensor data from the sensors to the server.

7. The system according to claim 6, wherein the protocol is one of 802.11, GPRS and ZigBee.

8. The system according to claim 1, wherein the sensors communicate with the server according to a predetermined wireless communication protocol.

9. The system according to claim 1, wherein the server utilizes at least one of (i) a fluid distribution network modeling module generating the stored data, (ii) a controller module controlling operation of components of the fluid distribution network, (iii) a learning module using the sensor data to generate the response procedure and (iv) a customer meter module obtaining a reading from a meter at a customer location.

10. The system according to claim 9, wherein the components include at least one of a valve, a pump and a tank.

11. The system according to claim 1, wherein the response procedure includes at least one of (i) an alert message to a field personnel, (ii) a visual indicator on a display coupled to the server and (iii) generating a list of responsive actions.

12. A method, comprising:

receiving sensor data from a plurality of sensors disposed at predetermined locations in a fluid distribution network, the sensor data indicative of at least one predetermined characteristic of flow through the network, wherein the sensors include one of Motes and Smartdust;

comparing the sensor data to stored data to determine an existence of a problem condition in the network;

executing a predetermined response procedure when the problem condition is determined to exist;

displaying a map image of the fluid distribution network; and utilizing a layering function to project on the map image at least one of (i) a topography of land underlying the fluid distribution network, (ii) an infrastructure of the fluid distribution network, (iii) locations of at least a portion of the plurality of sensors and (iv) the sensor data generated by each of the plurality of sensors.

13. The method according to claim 12, wherein the network is one of a drinking water network, a sewage network, an oil network, a gas network and an irrigation network.

14. The method according to claim 12, wherein sensor data includes at least one of temperature, humidity, barometric pressure, ambient light, pressure, flow rate, conductivity, dissolved oxygen, hydrogen sulfide gas and contaminant level.

15. The method according to claim 12, further comprising:

generating the stored data using a fluid distribution network modeling module.

16. The method according to claim 12, further comprising:

controlling operation of components of the fluid distribution network as a function of the response procedure.

17. The method according to claim 12, wherein the components include at least one of valves, pumps and tanks.

18. The method according to claim 12, wherein the response procedure includes at least one of (i) an alert message to a field personnel, (ii) a visual indicator on a display and (iii) generating a list of responsive action.

* * * * *